US006440271B1

(12) United States Patent
Heikkinen et al.

(10) Patent No.: US 6,440,271 B1
(45) Date of Patent: Aug. 27, 2002

(54) METHOD AND APPARATUS IN MOISTENING OF A WEB

(75) Inventors: Antti Heikkinen, Helsinki; Mikko Tani, Tuusula, both of (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/743,558

(22) PCT Filed: Jul. 9, 1999

(86) PCT No.: PCT/FI99/00608

§ 371 (c)(1),
(2), (4) Date: Jan. 9, 2001

(87) PCT Pub. No.: WO00/03086

PCT Pub. Date: Jan. 20, 2000

(30) Foreign Application Priority Data

Jul. 10, 1998 (FI) ..... 981594

(51) Int. Cl.[7] ..... D21F 7/00

(52) U.S. Cl. ..... 162/207; 162/206; 162/265; 162/DIG. 6

(58) Field of Search ..... 162/135, 136, 162/137, 158, 199, 206, 207, 265, 272, 274, 275, 205, 204, 361, 290, 271; 34/428, 444, 446, 611; 100/38, 74; 8/149.1, 149.2, 149.3, 156

(56) References Cited

U.S. PATENT DOCUMENTS

| | | | | | |
|---|---|---|---|---|---|
| 3,948,721 | A | * | 4/1976 | Winheim | 162/207 |
| 4,474,643 | A | | 10/1984 | Lindblad | 162/198 |
| 4,945,654 | A | | 8/1990 | Mason | 34/23 |
| 5,286,348 | A | | 2/1994 | Perin | 162/262 |
| 5,378,497 | A | * | 1/1995 | Johnson et al. | 427/211 |
| 5,505,820 | A | * | 4/1996 | Donigian et al. | 162/206 |

FOREIGN PATENT DOCUMENTS

| | | | |
|---|---|---|---|
| EP | 0617165 | 9/1997 | D21G/1/00 |

* cited by examiner

*Primary Examiner*—Peter Chin
*Assistant Examiner*—Eric Hug
(74) *Attorney, Agent, or Firm*—Steinberg & Raskin, P.C.

(57) ABSTRACT

In the method in moistening of a web, water is applied with a wetting device (2) in a predetermined point on the surface of a paper web (W) or the like passing by the point, and the web is thereafter passed to a calender (C). The liquid is applied at such an early stage that before the surface treatment, the fibres exposed to wetting in the paper web (W) or the like have the time to absorb it at least 80% of the amount of liquid they are capable of absorbing. The distance travelled by the web between the drying section and the calender is increased with rolls (1) which guide the web (W) along a winding path.

29 Claims, 5 Drawing Sheets

METHOD AND APPARATUS IN MOISTENING OF A WEB

FIELD OF THE INVENTION

The invention relates to a method in moistening of a web, in which liquid is applied in a predetermined point on the surface of a paper web or the like moving past the point, whereafter the web is guided to surface treatment. In particular, the invention relates to a method in which the surface of a paper web is wetted in a wetting unit in the paper machine before the web is calendered. The invention also relates to an apparatus for implementing the aforementioned method. Hereinbelow, the term paper web refers to all materials in the form of a flexible web made of fibrous material and capable of absorbing liquid.

BACKGROUND OF THE INVENTION

After the paper has been dried, the surface structure of a web is made suitable by means of a mechanical treatment, calendering. There are several calendering methods, but it is common to all of them that the web is passed through one or several nips which are formed between two surfaces, typically between rotating roll surfaces. The purpose of the calendering is to improve the paper quality by pressing the paper into a fixed final thickness, and especially by smoothing its surface. As is well known, the mouldability of the fibres contained in the paper or paperboard, the "plasticization" of the web in connection with the calendering, can be improved by increasing the temperature and/or moisture. The mouldability of the polymers contained in the paper can be increased by raising the treatment temperature to or above their glass transition temperature. By increasing the moisture content it is, in turn, possible to lower the glass transition temperature. It is often advantageous to restrict the impact of the temperature and moisture only on either surface layer or on both surface layers of the web, wherein the mouldability of their fibres can be improved without excessively affecting the central layer of the web. As a result of this, a known procedure is the wetting of the surfaces of the web before the calendering of the web. Another known procedure is the adding of steam before the nip between the calender rolls, wherein a preheating of the surface is also attained. Calendering processes are presented for example in the European patent 617165.

At present, the manufacture of SC paper requires so-called overdrying of the paper. This means that the paper is dried before calendering into a moisture which is smaller than its moisture of use. Maximally this means that the paper is dried very dry down into a moisture range of 1.5 to 2.5.

Overdrying is well founded, because the moisture expansion potential of the paper is reduced when the smallest moisture content which it experiences during the papermaking is reduced. Small moisture expansion potential improves the printability of the product. Furthermore, at present, overdrying and re-wetting produce better profiles in view of calendering when compared to drying of the paper directly to the target inlet moisture of the calendering.

Particularly in the manufacturing processes of SC paper the paper has to be wetted to attain the correct target moisture. In Off-line processes the wetting and the location in which it is conducted are not very crucial, because the moisture profiles, tensions and other corresponding variables of the paper have the time to be sufficiently equalized in the reel field before supercalendering. In on-line processes, in turn, it is important to reach the correct moisture of the paper before calendering.

The problem in the wetting of a web in the form of a continuous strip is that it is difficult to set the water content absolutely accurately to attain the desired moisture gradient in the thickness direction of the web. There is a risk that the moisture gradient is set too low, and the flattening effect of the calendering is unnecessarily directed to the central layer of the web instead of being directed in a most appropriate manner to the surface fibres of the web. However, in view of the final quality of the paper or paperboard, it is important that the calendering is successful. Thus, a correct dosage of water is the basic condition for a successful surface treatment.

To attain a sufficiently steep moisture gradient, it is possible to use arrangements known as such which relate to the structure and/or placement of wetting devices, but despite these arrangements the moisture gradient can be disadvantageous when the web enters the calender. Thus, the problems relate to the build-up of a correct moisture gradient as a result of the absorption of water taking place after the wetting devices. It is possible that after the wetting the absorption of water in the web before the calender is insufficient, or too much water is absorbed in the web. Similarly, it is a problem that with water the desired effect is not attained in the calendering. This may result in that the web remains unevenly wetted, the central layer of the web is unnecessarily wetted, or the fibres will be insufficiently moulded in the nip.

A known manner is to arrange the wetting devices in connection with the calender very close to the calender nip, as is presented e.g. in the European patent 617165 and in the U.S. Pat. No. 4,945,654.

OBJECTS AND SUMMARY OF THE INVENTION

It is a purpose of the invention to reduce the aforementioned problems and to introduce a method by means of which the intended wetting can be achieved. To attain this purpose, the method according to the invention is primarily characterized in that liquid is applied at such an early stage that the fibres exposed to wetting in the paper web or the like have time to absorb the liquid at least 80% of the total amount of liquid they are capable of absorbing before the surface is treated. The web is guided to surface treatment in the moisture content obtained by adding the liquid.

The period of time during which the wetting is effective after the wetting can be influenced especially by adjusting the distance travelled by the web from the wetting point, which can be implemented e.g. by changing the respective location of the rolls in the roll system guiding the web in such a way that the overall length of the path of the web in the roll system is changed.

The invention is based on the observation that in the end, only an optimal influence time of the wetting on the web when it travels from the wetting devices to the calender, is capable of ensuring the intended moisture effect. The web is wetted into the target moisture, and it is guided in this moisture into the calender nip.

Other features characteristic to the method according to the invention appear in the appended dependent claims, which present additional adjustment manners and possibilities to influence the uniformity of the wetting.

The apparatus according to the invention comprises a device for adding liquid, which is placed at such a distance from the device conducting surface treatment, taking into account the speed of the web, that the liquid added to the web will have time to be absorbed in the fibres exposed to wetting in the web at least 80% of the total amount of liquid which the fibres are capable of absorbing.

BRIEF DESCRIPTION OF THE DRAWINGS

In the following, the invention will be described in more detail with reference to the appended drawings, in which.

DETAILED DESCRIPTION OF THE PREFERRED EMBODIMENTS

Figure 1:
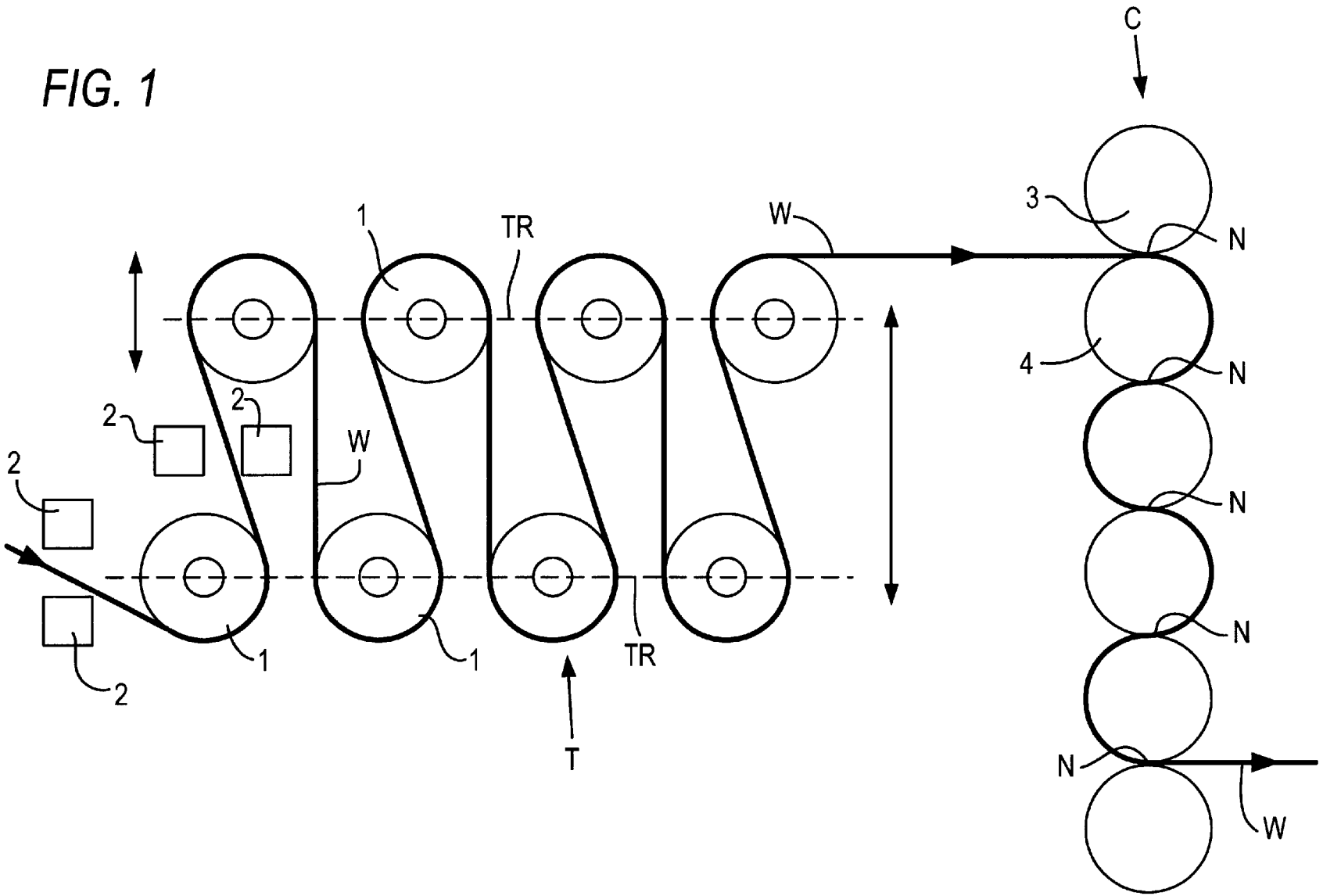
FIG. 1 shows the principle of the method according to the invention, and at the same time the apparatus according to the invention in a side view.

FIG. 1 shows schematically a paper or paperboard web W coming from a drying section in a paper or paperboard machine, which web W is passed via a wetting unit to a calender C. The wetting unit comprises at least one wetting device 2, by means of which one surface of the web W is moistened in a way known as such, and which wetting device 2 can function in any one of the following principles:

spray wetting, film transfer wetting (LAS, sym-sizer etc.), moistening by adjusting the relative humidity of air, steaming, if necessary combined with the cooling of the web before steaming, Naturally, in two-sided wetting, it is possible to use different wetting principles on different sides of the web W. In the wetting the web W obtains the desired surface moisture, and it is passed in this moisture in the calender nip N of the calender. The calender may be of a known calender type, but the invention is applicable especially before an on-line calender which contains over four nips, such as a calender formed of successive roll pairs or a stack of calender rolls shown in the drawing. The invention is applicable especially in the manufacturing process of SC paper before on-line calendering effected with aforementioned multi-nip calender types.

As can be seen in FIG. 1, there is a wetting device 2 on both sides of the web W. On both sides there are also several successive wetting devices 2, in FIG. 1 two wetting devices.

Because, however, there occurs absorption of moisture in the surface layers of the web W in the wetted web W after the wetting, and from the surface layers further into the central layer of the web W, it is necessary to set the overall length of the path of the web between the last wetting device 2 and the nip N of the calender in such a way that the arrival of the web in the calender C lasts for a period of time after which the web W has been wetted optimally in view of calendering. In other words, the web is sufficiently wetted especially in its outer layers while the central layer remains substantially drier in such a way that a sufficiently steep moisture gradient is produced in the web W in its z-direction (i.e., perpendicular to a surface of the web).

The period of time is especially such that the fibres exposed to wetting have the time to absorb at least 80% of the water amount they are capable of absorbing, of the water added in the wetting on the same side of the web W from one or more wetting devices 1. The term absorption refers to the swelling of paper web fibres, typically wood fibres, which consists of water adsorption, absorption, diffusion transfer of water to the fibre, as well as of a transfer induced by osmotic pressure, in other words the swelling of the fibres should be at least 80%.

Figure 2:
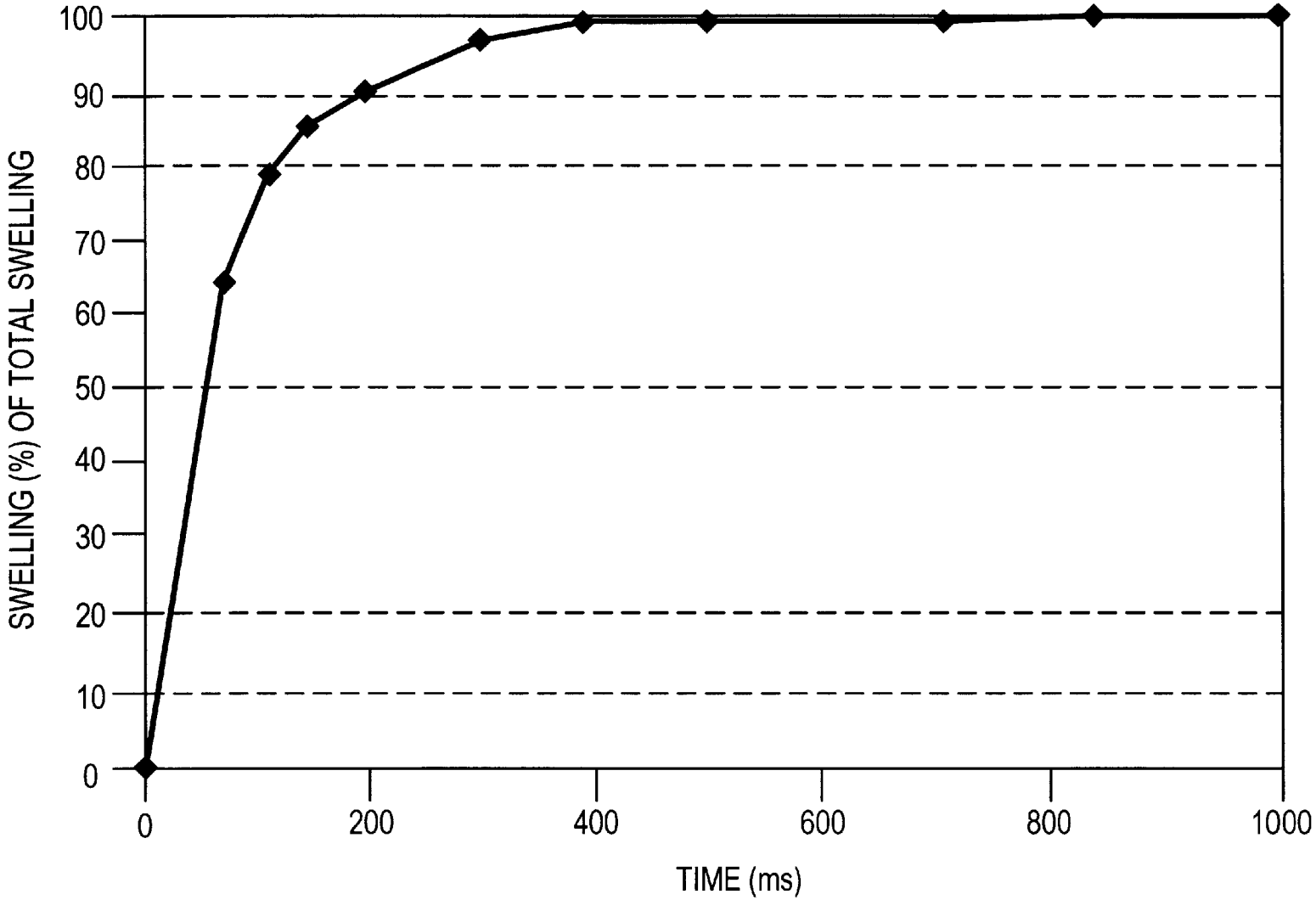
FIGS. 2 to 5 illustrate the absorption of water and the effect of the water amount.

In practice, the sufficient absorption of water into the fibres takes approximately 0.3 s, at the shortest. FIG. 2 shows the water sorption times of single fibres measured in laboratory conditions. For single fibres the relevant water amount in view of calendering would be approximately 80% of the maximum, i.e. the corresponding absorption time would thus be approximately 200 ms. In practice, the fibres are not disposed individually, but they are tightly connected together in the network structure of the paper, and the network structure of the paper as well as the application conditions of the water decelerate the absorption of water in such a way that the presumable minimum time is the aforementioned 0.3 s. In some advantageous conditions, the minimum time can be 0.2 s, including a small safety margin.

The optimal application time naturally depends on the fibrous material and the surface chemistry of the paper, as well as on the network structure. As a result of the transition from chemical pulps towards mechanical pulp the necessary absorption time is increased. Therefore it is advantageous to apply the water 0.2 to 2 s, advantageously 0.3 to 2 s before the nip, depending on the paper grade. The most advantageous absorption time of most processes is 0.5 to 1.0 s. For example in the manufacturing process of paperboard, the running speeds can be 600 m/min. Thus, it is advantageous to place the wetting device in a distance of 2 to 10 m from the first calender nip (corresponding the time of 0.2 to 1.0 s). In a typical manufacturing process of SC paper the running speed can be 1500 m/min. Thus, it is advantageous to place the wetting device 5 to 25 m before the first calender nip (corresponding the time of 0.2 to 1.0 s).

On the other hand, water breaks the bonds between the fibres in the paper, relaxes the tensions developed during the drying in the paper, and generates hydroexpansion of paper, which reduces the effect of streaks (variable moisture cross profile) resulting from the drying section and equalizes the cross profile of the paper. For example in SC papers, to implement the aforementioned processes the optimum result of the wetting is to be expected within the period of 500 to 1500 ms, advantageously 600 to 1300 ms, which at the running speed of 1500 m/min corresponds to the distance of 12.5 to 37.5 m and 15 to 32.5 m, respectively.

In machines utilizing high running speeds it is thus basically advantageous to place the wetting device as far as possible before the calender. The upper limit of the placement distance of the wetting device is determined on the basis of the structure of the paper machine and/or the moisture retention. If the wetting device is placed too far before the first calender nip, it is possible that re-drying takes place in the web. This takes place especially if the wetting device is inside the drying section e.g. before the last dryer group. An advantageous location point in all paper or paperboard machines and especially in SC paper machines, is at the most 40 m, advantageously at the most 35 m before the first calender nip of the calender, and advantageously after the drying section. In high-speed machines the long placement distance required by the speed and measured along the travel path of the web can be implemented, irrespective of the straight fixed distance of the drying section and the calender in the machine direction, with an arrangement which will be described hereinbelow.

Figure 4:
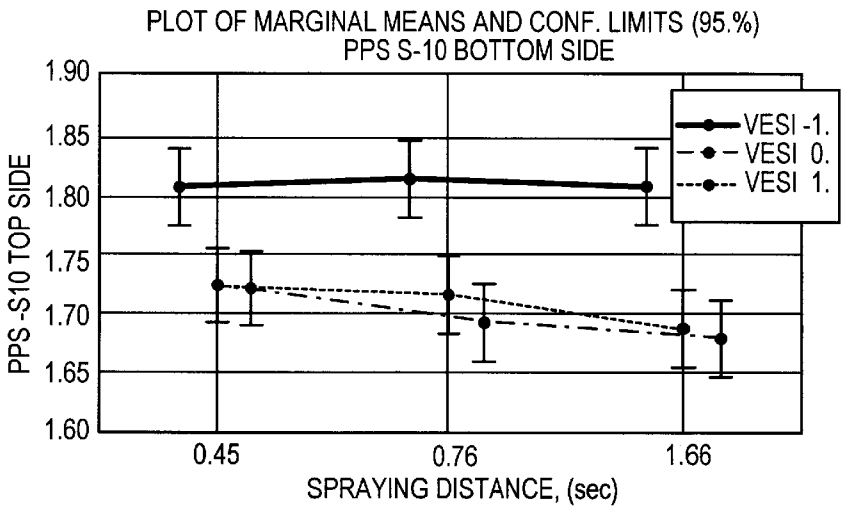
Figure 3:
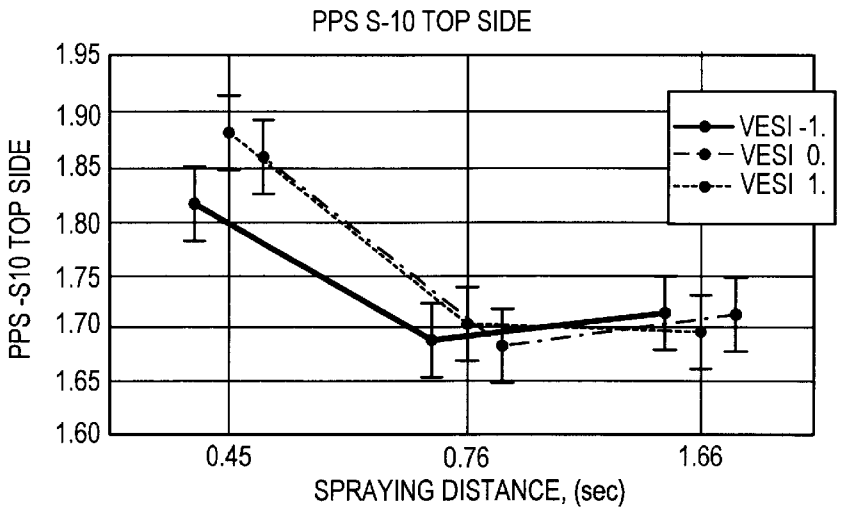
Figure 5:
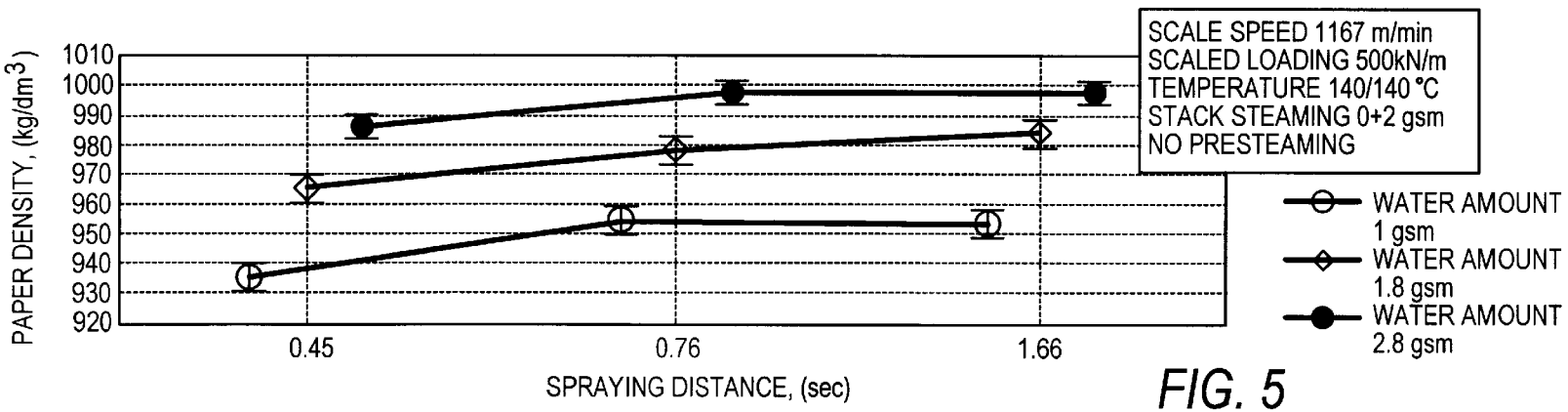

Sufficient absorption time ensures that the polymers contained in the fibrous material of the paper are plasticized by the effect of water. This, in turn, improves the calendering result considerably. FIGS. 3 and 4 show the development of PPS as a function of the absorption time with different added quantities, wherein FIG. 3 shows the results on the upper side of unsprayed SC paper and FIG. 4 the results on the lower side of sprayed SC paper. In the drawings, the water amount "−1" denotes an increase of 1 g/m$^2$, "0" an increase of 1.8 g/m$^2$ and "1" an increase of 2.8 g/m$^2$. FIG. 5 shows the development of density as a function of the absorption time, and it also describes the experiment conditions of FIGS. 3 and 4.

In conventional solutions there is not enough time for the water to be sufficiently absorbed. Thus, the effect of the water is primarily based on its bond-breaking effect between the fibres, wherein the surface layer of the paper is slackened and its mouldability is improved as a result of this. The method according to the invention utilizes both positive effects of the water, thus enhancing the calendering considerably. Thus, the applied water amount is larger than the amount which would be necessary for wetting the fibres with the actual adsorption, i.e. there is also free water between the fibres in the surface layer of the web.

Long influence time is advantageous also in view of the result of applying the liquid. If the liquid is applied on the surface of the web W by spraying in droplets, the film in question is discontinuous even in best spraying processes. To avoid drop marks, the liquid is given time to spread in the direction of the plane of the web. Thus, it is possible to avoid small-scale gloss variations of the paper resulting from the uneven liquid film.

In the following, an advantageous manner of passing the web on the portion between the drying section and the calender will be described.

Since the distance travelled by the web from the wetting point to the calender is relatively long in high-speed machines to ensure a sufficient absorption time, it is advantageous to arrange the web W to travel along a winding or meandering path by guiding it between upper rolls 1 and lower rolls 1 in a roll system T arranged between the drying section and the calender. Thus, the distance can be increased irrespective of the horizontal distances available in the paper machine. The rolls 1 are located after the wetting device 2. As shown in FIG. 1, between two successive wetting devices 2 which wet the same side of the web there is a roll 1 by means of which the distance of the wetting devices from each other can be increased.

The distance between the wetting device 2 and the nip N can also be affected by changing the mutual location of the rolls 1 in the roll system T in such a way that the overall length of the path of the web W in the portion of the roll system T is changed. To implement this, the location of at least one roll 1 in the roll system T is changed, i.e. the distance between two successive rolls 1 is changed, wherein the overall length of the path between the first and the last roll 1 of the roll system T is changed. To change the distance, the roll 1 can be moved in the longitudinal direction of the wetting unit and/or in its height direction, but it is obvious that in view of the space economy required by the paper machine, the transfer of the roll 1 substantially in the height direction is the most advantageous embodiment.

Similarly, by moving the roll 1 between the wetting devices 2, it is possible to change the distance between the wetting devices 2 without moving them.

With regard to implementing the purpose of the invention, it is advantageous that- instead of the possibility of moving one roll 1, several rolls 1 are arranged movable in the roll system T simultaneously or at different times. Thus, it is typical for the wetting unit that the rolls 1 are arranged to form special roll rows TR (preferably two on top of each other, as shown in the drawing), which is advantageous in view of the space economy of the paper or paperboard machine. Thus, an advantageous embodiment of the invention is such where an entire roll row TR is arranged to be moved especially substantially in the height direction in relation to the second roll line TR or other roll row TR.

To move the rolls 1 and/or roll rows TR it is possible to use force device arrangements, power transmission arrangements, control automation arrangements or corresponding arrangements known as such in connection with the papermachine technology. Especially for the transfer of an entire roll row TR, necessary support structure, coupling and other corresponding arrangements for simultaneous motion of the rolls are provided, which arrangements are based on prior art. It is obvious that by means of said arrangements it is possible to implement an embodiment in which either one or more rolls 1 can be moved separately in addition to moving the entire roll row TR.

The aforementioned facts also apply in the special case where the wetting unit is provided with only one roll 1, wherein the shortest overall length of the path of the web W is substantially formed of the straight line between the wetting device 2 and the calender C, and the total length can be increased by turning the path of the web W with the roll 1. When the aforementioned distances of several metres are taken into account, a more advantageous solution entails at least two rolls 1 or the like which increase the travel path of the web. A multiple-roll structure with at least three rolls 1 or the like between the wetting device 2 and the calender C, is the most advantageous one.

It is possible to think that the rolls 1 are replaced with any other means which guide the travel of the web, and which can be moved to alter the length of the travel path of the web.

After the wetting unit the web W travels to a calender C whose two first rolls are illustrated in the drawing by rolls 3 and 4, forming a calender nip N therebetween through which the web W is passed. The nip in question can be the only nip of the calender C, or as shown in FIG. 1, it is the first nip in a multi-roll calender in which there are several successive calender nips N in the travel direction of the web W. In the nip N the heated roll is naturally on that side on which the web has been subjected to wetting. If the wetting has been conducted on both sides, both roll surfaces can be heated.

The method and the apparatus are used especially in connection with a machine calender functioning as a direct extension for the papermaking process, but it is also possible to use them when a paper web from an intermediate storage is calendered at a separate working stage, wherein the unwound paper is subjected to wetting before it is passed to the first calender nip.

By means of a sufficiently long residence time after adding liquid it is possible to improve the uniform absorption of water in the direction of the plane of the paper web as well. In the following, some ways of improving the adding of liquid with the wetting devices 2 especially in the direction of the plane of the web W will be described.

As was stated above, it has proved to be considerably difficult to apply a sufficiently even water film for the purpose of calendering on the surface of the paper by means of a spray jet. In present configurations, the uneven quality of the film manifests itself in an uneven calendering result and surface damages, such as drop markings. With a sufficiently long absorption time these problems can be reduced. In the following, another way of improving the applying result especially when using spraying in droplets, will be described.

The basic requirement for producing an even water film includes well-functioning spray nozzles with a known function. It is difficult to find such nozzles because in present applications the accuracy requirements are insignificant, the manufacturing tolerances of the nozzles are too high in most cases, and it is very difficult to estimate and measure the function of the nozzles (droplet size distributions, coverage in the paper, the moisture transferred to the paper as well as the uniformity of the moisture).

Figure 6:
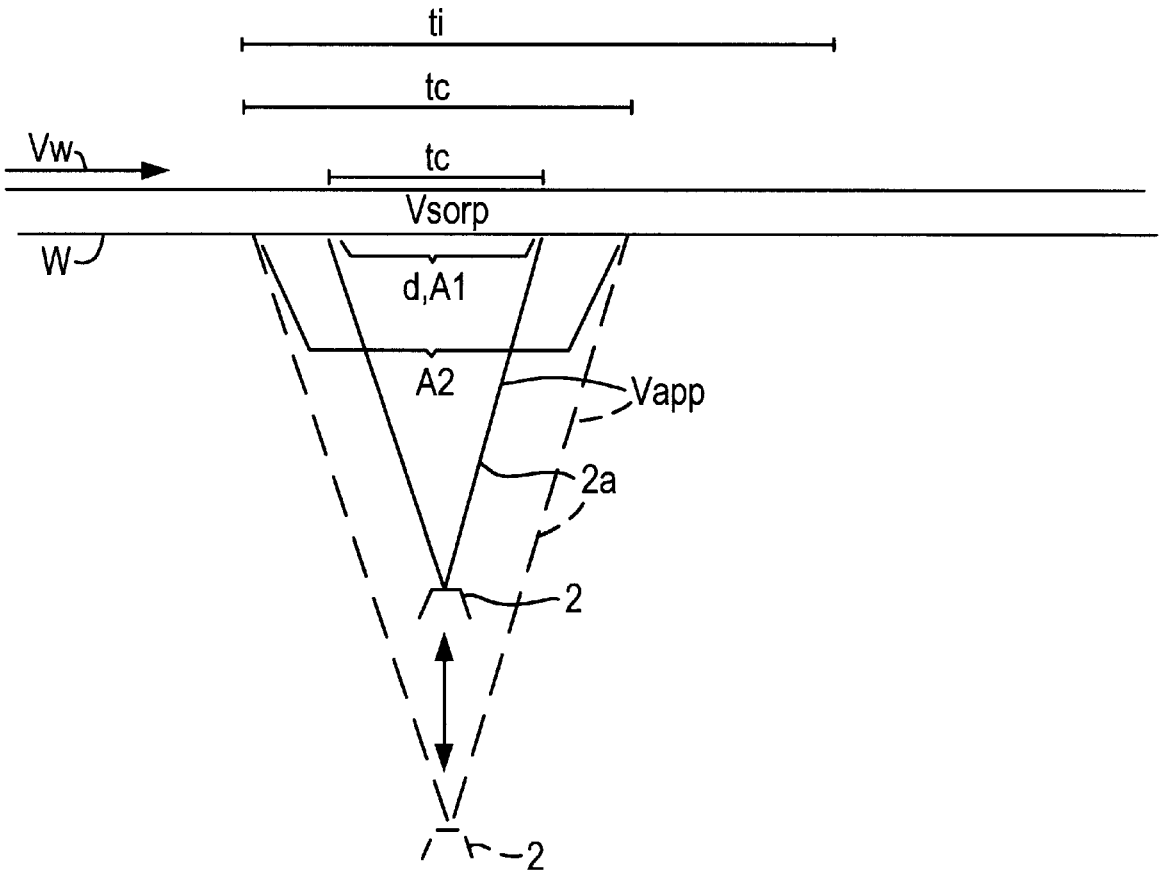
FIG. 6 illustrates the dosage of water and its adjustment principle to attain an even two-dimensional application.

By using the present basic nozzles as wetting devices 2, it is possible to attain an even water film in the wetting. The method is based on the knowledge of the water sorption capacity of the paper. Certain paper grade is capable of bonding and absorbing a particular water amount on a fixed surface area in a given time unit. FIG. 6 shows schematically the principle in the spray wetting effected from underneath the web W.

If the water amount is statistically sufficiently larger than the aforementioned water sorption capacity, it is possible to adjust the water amount by regulating the length of the jet in the machine direction of the web, and thus an even water film is attained despite the small irregularities of the jet. The water amount denotes the amount of liquid per surface area unit applied from the wetting device during one time unit. The amount must be considerably larger so that the loss of water bouncing from the surface would be taken into account.

FIG. 6 shows a spray beam 2*a* issued from a spray nozzle functioning as a wetting device. In the drawing, the designations in the longitudinal direction of the web can also be treated as surface areas, since the phenomena prevail on the entire width of a standard width web W.

The contact time tc is d/Vw, in which d is the length of the spray beam 2*a* on the surface of the web and Vw is the speed of the web W. The water amount Vapp, the unit e.g. $g/(m^2 \times s)$, sprayed on the surface area A1 covered by the jet, is dependent on the length d of the beam, and on the spraying velocity of the nozzle. On the other hand, the web W has a paper-grade-specific water sorption capacity Vsorp, which indicates the capability of the surface to absorb the water amount per surface area and time unit, the unit also $g/(m^2 \times s)$. A water amount larger than the water sorption capacity is sprayed, i.e. Vapp>Vsorp. In practice this also means that the absorption or imbibition time ti is longer than the contact time tc, i.e. after the beam 2*a*, there is an even liquid film on the surface of the web W. When this is combined with a long influence time before the calender, a very uniform wetting is attained.

By arranging the distance of the nozzle from the web W adjustable, it is possible to alter the length d (surface area) of the beam 2*a* e.g. into a surface area A2, wherein Vapp is also changed while the flow rate (g/s) of the nozzles remains constant.

Vsorp is dependent on several factors, such as the composition of the paper and the application conditions (air flows, linear velocity of the jet, spraying angle). This can be determined for paper grades in accordance with the conditions.

It is advantageous to add an amount of liquid which effects the swelling of fibres into the web W at least in two successive points, wherein it is possible to apply smaller quantities at a time. Thanks to this, the water can be directed to the surface layer that is important in view of the calendering result, which is significant e.g. when producing SC paper grades. Even though a good effect is obtained with one addition, addition in portions in two or more successive points is advantageous especially with increasing smoothness and/or hydrophobicity of the paper or if the form of the moisture gradient is important.

The absorption of water in successive portions into the web can be arranged in such a way that in the first adding point most of the added water has been absorbed in the web, while part of it remains as a surface water in the roughness volume of the paper or paperboard when the next portion is added. Thereafter it is possible to add a third portion at a stage where most of the surface water+the water added at the preceding stage has again been absorbed in the web.

Figure 7A:
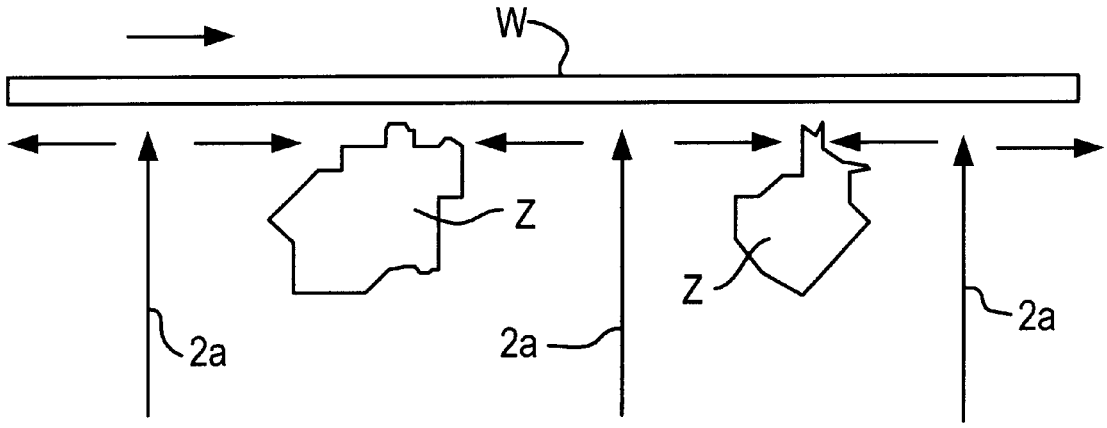
FIG. 7a PRIOR ART
FIG. 7*a* is an elevational view depicting turbulence zones associated with prior art spraying techniques.

The act of applying a water film or other liquid applied by spraying evenly on the surface of a moving web may thus require the use of several sucessive water jets. When the web is moving at a high speed, the water jets must have a considerably high speed so that they can be brought in contact with the web. Spraying experiments have revealed turbulence phenomena on the surface of the web, which are due to uncontrolled flows of air. In FIG. 7*a* these turbulence zones are marked with the letter Z.

In the turbulence zone the mixture of air and water bouncing from the surface of the web migrates against the surface of the web and causes so-called "wind" marks on the surface of the web; i.e. quantitative fluctuation occurring at intervals of 5 to 10 cm, which impairs e.g. the calendering result.

Figure 7B:
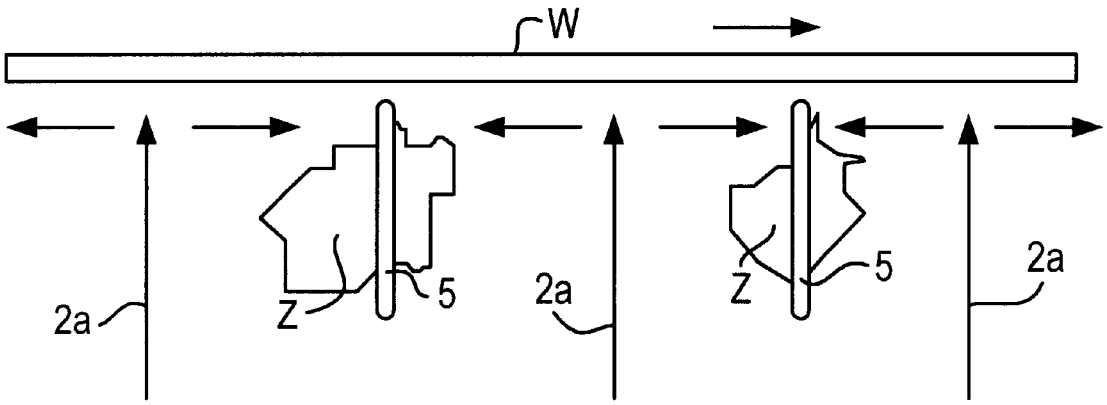
FIG. 7*b* shows an advantageous manner to attain an even application two-dimensionally with respect to the plane of the web.

In FIG. 7*b*, control elements 5 are arranged between the jets 2*a* or on both or on one side of a single jet, depending on the spraying angle. By means of the elements the mixture of air and water bouncing from the surface of the web is directed in such a way that it does not interfere with the preceding water jet and end up on the surface of the web again, wherein the extremely harmful wind marks are eliminated. Thus, the elements also improve the controllability of the entire system. The control elements 5 can be for example walls directed towards the surface of the web W, which walls come sufficiently close to the surface of the web so that the mixture of air and water which is located close to the surface of the web collides with them. FIG. 7*b* illustrates spray-wetting underneath the web, in which water can run downwards along the surfaces of the elements 5. The method can also be applied from other directions, e.g. for wetting effected from above, in which the elements can have such a structure that they do not spill water back to the web, i.e. they can be for example water absorbent.

The invention is not restricted solely to the above-presented description and drawings, but it can vary according to the appended drawings. Even though the preceding description is focused on the spray-wetting, the advantageous effects of the invention in the finishing of paper or paperboard web can also be attained with other wetting methods.

In particular, the invention can be applied for on-line papermaking in which the paper is dried after the formation down to a final moisture area of 2 to 6%, and the target moisture in re-wetting is 8 to 11%.

The liquid to be applied is typically water, wherein it can be water as such or contain other substances as solutes.

The treatment of the surface of the web conducted after the wetting is, in turn, of such a type that the wetting of the surface is useful. It is for example mechanical moulding, possibly with a thermal treatment connected thereto. Calendering provides a practical example of such a treatment.

The present invention has been described herein with reference to preferred embodiments of the invention however the description provided herein is for illustrative purposes and should not be considered to be exhaustive. It is understood that modifications and variations of the above describe preferred embodiments are possible without departing from the spirit or scope of the present invention.

What is claimed is:

1. A method for the moistening of a paper web in a paper or paperboard making process, comprising the steps of:

applying a liquid to a surface of said paper web while said paper web is passing a predetermined point in said process;

passing said paper web to a surface treatment process in a calender having at least four nips;

providing a sufficient amount of absorption run time of said paper web between said applying of said liquid to said paper web and said passing of said paper web to said surface treatment process such that at least 80% of an amount of said liquid which is absorbable by said paper web is absorbed;

providing a paper web guiding system comprising a plurality of paper web guiding members structured and arranged between said point of applying said liquid to said paper web and said passing of said paper web to said surface treatment process; and adjusting said absorption run time of said paper web by changing a location of at least one of said paper web guiding members.

2. The method according to claim 1, wherein said liquid is applied to said paper web at least 0.2 seconds before said passing of said paper web to said surface treatment process.

3. The method according to claim 1, wherein said liquid is applied to said paper web between about 0.2 seconds and 2 seconds before said passing of said paper web to said surface treatment process.

4. The method according to claim 1, wherein said liquid is applied to said paper web between about 0.5 seconds and 1.5 seconds before said passing of said paper web to said surface treatment process.

5. The method according to claim 1, wherein said liquid is applied to said paper web in a spray wetting process.

6. The method according to claim 1, further comprising the step of guiding said paper web along a winding path between said point of applying said liquid to said paper web and said passing of said paper web to said surface treatment process, wherein said winding path is formed by at least one guiding member.

7. The method according to claim 1, wherein said adjusting of said absorption run time of said paper web is effectuated by adjusting the location of at least one of said paper web guiding members in a direction transverse a running direction of said paper web.

8. The method according to claim 1, wherein said paper web guiding system comprises a pair of rows of guiding members each row having at least two guiding members associated therewith over which said paper web travels, wherein said absorption run time is adjusted by changing a location of at least one of said pair of rows of guiding members.

9. The method according to claim 8, comprising the step of:

adjusting absorption run time by changing a location of at least one of said pair of rows of guiding members in a direction transverse a running direction of said paper web.

10. The method according to claim 1, comprising the step of:

applying an amount of liquid greater than a sorption capacity of said paper web.

11. The method according to claim 10, comprising the steps of:

applying said liquid to said paper web in the form of a spray jet; and adjusting an amount of liquid applied to said paper web by adjusting a length of said spray jet in a running direction of said paper web.

12. The method according to claim 11, comprising the step of:

adjusting said length of said spray jet by adjusting a distance of spray nozzle, from which said jet is sprayed, from said paper web.

13. The method according to claim 10, comprising the steps of:

applying said liquid to said paper web in the form of a spray jet; and applying said spray jet to said paper web from underneath said paper web.

14. The method according to claim 1, comprising the step of:

applying said liquid to said paper web in at least two portions on a same side of said paper web.

15. The method according to claim 14, comprising the step of:

applying said liquid to said paper web in at least two successive spray wettings on at least one side of said paper web.

16. The method according to claim 1, comprising the step of:

applying said liquid to said paper web by spray wetting through a jet; and controlling an air flow, created by said spray wetting, with at least one control element structured and arranged on at least one side of said jet in a travel direction of said web.

17. The method according to claim 16, wherein said air flows created between a pair of successive jets is controlled by said at least one control element.

18. The method according to claim 1, wherein said applying of said liquid is applied in the manufacture of SC paper and wherein said liquid is applied to a paper web coming from a drying section before an on-line calendering step.

19. The method according to claim 18, wherein the paper web is dried to a final moisture area of 2% to 6% and is rewetted to a target moisture of 8% to 11% before said calendering step.

20. The method according to claim 1, wherein said applying of said liquid is effectuated after a drying section in a paper machine.

21. The method according to claim 1, wherein said paper web guiding system comprises at of guiding members having at least two guiding members associated therewith over paper web travels, and between which the web is guided over a guiding member excluded row of guiding members, wherein an absorption run time is adjusted by changing a location of guiding members.

22. An apparatus for the moistening of a paper web in a paper or paperboard machine, comprising:

a calender having at least four nips structured and arranged for treating said paper web;

at least one web wetting device, for adding a liquid to said paper web, structured and arranged before said calender in a machine running direction; wherein said at least one web wetting device is located a predetermined web running distance before said calender such that said liquid added to said paper web has sufficient time for at least 80% of the total amount of said liquid which said paper web can absorb is absorbed before reaching said; and at least three rolls structured and arranged between said calender and said at least one wetting device, said at least three rolls comprising a first roll and a last roll and being structured and arranged to guide said paper web along a winding path having an overall length between the first roll and the last roll, and at least one of said at least three rolls being structured and arranged to be changeable to another location such that the overall length of the path between the first roll and the last roll is changed to effect in a web running distance.

23. The apparatus according to claim 22, wherein said at least one web wetting device is located at the most 35 web running meters before said surface treatment member.

24. The apparatus according to claim 22, wherein said at least one web wetting device is located between about 5 and 25 web running meters before said surface treatment member.

25. The apparatus according to claim 22, wherein said at least one web wetting device is located between about 2 and 10 web running meters before said surface treatment member.

26. The apparatus according to claim 22, further comprising:

a roll system structured and arranged between said surface treatment device and said at least one web wetting device, wherein said roll system comprises at least two rolls arranged in at least one roll row; and wherein a location of at least one roll of said roll system is structured and arranged to be changeable in at least one of a transverse and longitudinal direction of said roll system, whereby a change in said location of said at least one roll effects a change in an overall travel length of said paper web within said roll system.

27. The apparatus according to claim 26, wherein the roll system comprises a pair of roll rows each roll row having at least two rolls; and wherein a location of at least one of said pair of roll rows is structured and arranged to be changeable in at least one of a transverse and longitudinal direction of said roll system.

28. The apparatus according to claim 26, wherein a location of said at least one roll row is changeable in a transverse web running direction.

29. The apparatus according to claim 22, wherein said at least one web wetting device is structured and arranged after a drying section of said paper or paperboard machine.

* * * * *